US006462478B1

(12) United States Patent
Oetken et al.

(10) Patent No.: US 6,462,478 B1
(45) Date of Patent: Oct. 8, 2002

(54) SAFETY SWITCH FOR LAMP INCLUDING A LIGHT SOURCE CAPSULE

(75) Inventors: James E. Oetken, St. Marys, PA (US); Joseph P. Gallant, Winchester, KY (US); Gerald A. Puracchio, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/927,967

(22) Filed: Aug. 10, 2001

(51) Int. Cl.[7] ..... H01K 1/62
(52) U.S. Cl. ..... 315/73; 313/317; 313/580
(58) Field of Search ..... 315/73, 56; 313/317, 313/318.01, 318.08, 318.09, 578, 579, 580

(56) References Cited

U.S. PATENT DOCUMENTS 3,619,710 A * 11/1971 Waymouth ..... 313/601
4,345,186 A * 8/1982 Saito et al. ..... 315/100
4,785,218 A * 11/1988 Kohl et al. ..... 313/318.07

* cited by examiner

*Primary Examiner*—Don Wong
*Assistant Examiner*—Thuy Vinh Tran
(74) *Attorney, Agent, or Firm*—William H. McNeill

(57) ABSTRACT

A safety switch for a lamp having an outer envelope with a light source capsule mounted therein. The lamp has a base for connection to an electrical circuit via a mating socket and has in-leads appropriately connected to the base and to the light source capsule whereby electrical power can be supplied to the light source. A fuse is operatively mounted to one of the in-leads in the base. The safety switch is mounted in the outer envelope and tensioned thereagainst whereby breakage of the outer envelope causes the safety switch to release and electrically contact the in-leads causing a short circuit and opening the fuse, thereby removing power from the capsule.

4 Claims, 2 Drawing Sheets

SAFETY SWITCH FOR LAMP INCLUDING A LIGHT SOURCE CAPSULE

TECHNICAL FIELD

This invention relates to lamps and more particularly to such lamps employing an outer envelope surrounding a light source capsule. The light source capsule can be an arc discharge source or a halogen incandescent source, both of which operate at very high temperatures and both of which may continue to operate in the event that the outer envelope breaks. In the case of an arc discharge source this breakage can expose outlying areas to potentially dangerous ultraviolet radiation and in the case of a halogen incandescent source, which is more likely to used in a home environment, can leave the very hot capsule exposed.

BACKGROUND ART

These problems have long been recognized in arc discharge lamps and safety features for extinguishing the capsule in the event of outer envelope breakage are available. Usually, this feature comprises an incandescent filament in series with one of the in-leads of the lamp. Since the outer envelope is evacuated the filament can even be used to add to the light output of the lamp by incandescing during operation. However, in the event of breakage of the outer envelope, the continuously burning filament is exposed to the oxygen of the air and virtually immediately burns through, opening the circuit and extinguishing the capsule. This solution works well in the relatively expensive arc discharge lamps and, relatively, adds little to the cost. Such a solution, however, would be expensive for the much less costly halogen incandescent lamps, which are normally used in the home environment.

DISCLOSURE OF INVENTION

It is, therefore, an object of this invention to obviate the disadvantages of the prior art.

It is another object of the invention to provide an economical shut-off feature for halogen incandescent lamps.

Yet another object of the invention is the enhancement of lamps employing light source capsules.

Still another object of the invention is the provision of a combination mechanical and electrical termination of a light source capsule used in an outer envelope in the event of outer envelope breakage.

These objects are accomplished, in one aspect of the invention, by mounting a safety switch in a lamp having an outer envelope with a light source capsule mounted therein. The lamp has a base for connection to an electrical circuit via a mating socket and has in-leads appropriately connected to the base and to the light source capsule whereby electrical power can be supplied to the light source. A fuse is operatively mounted to one of the in-leads in the base. The safety switch is mounted in the outer envelope and tensioned thereagainst whereby breakage of the outer envelope causes the safety switch to release and electrically contact the in-leads causing a short circuit and opening the fuse, thereby removing power from the capsule.

This combination mechanical-electrical safety switch is economical to manufacture and install and insures the deactivation of the light source capsule in the event of outer envelope breakage.

BEST MODE FOR CARRYING OUT THE INVENTION

Figure 1:
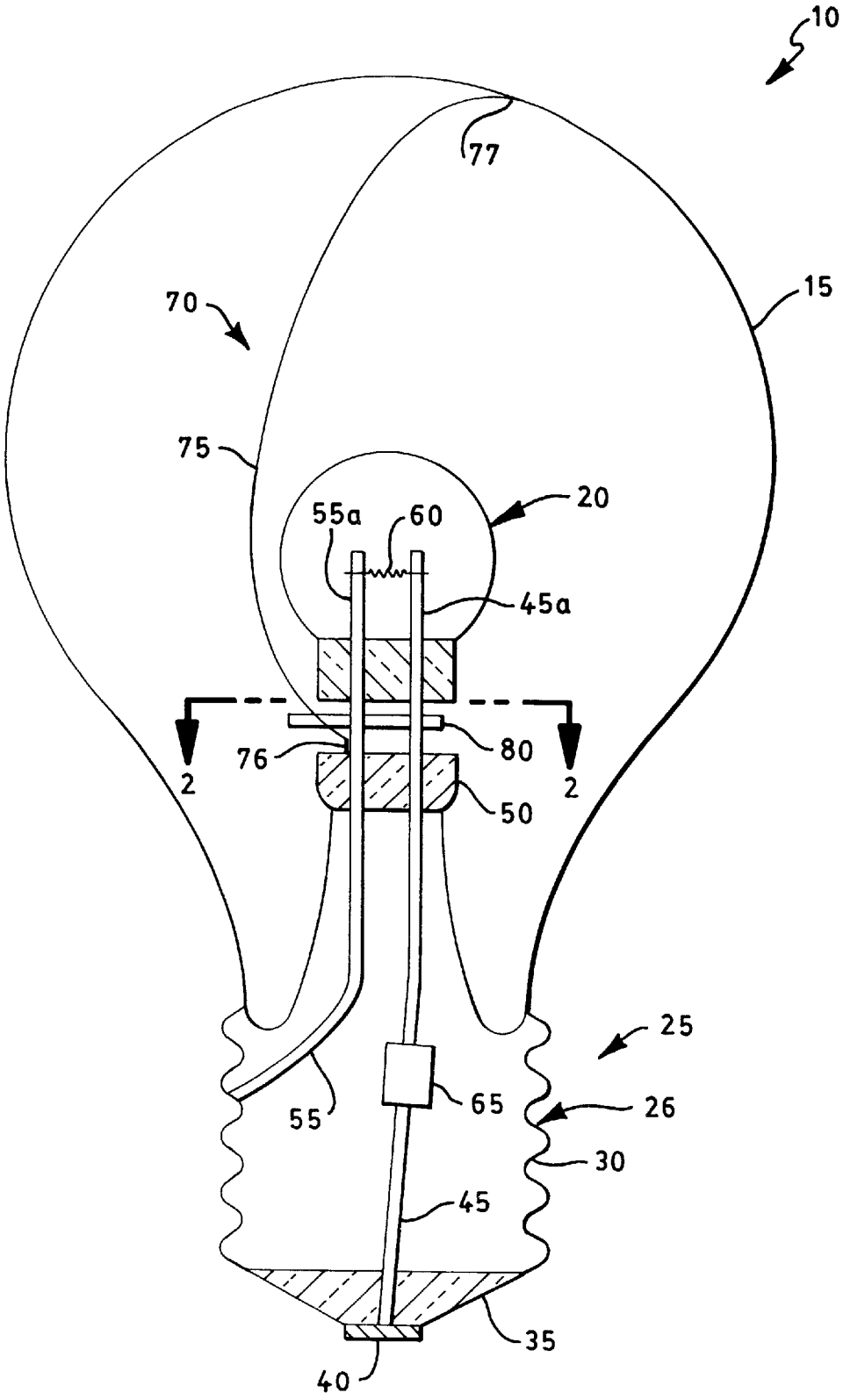
FIG. 1 is a diagrammatic view of a lamp employing the invention.

Referring now to the drawings with greater particularity, there is shown in FIG. 1 a lamp 10 having an outer envelope 15 containing a light source capsule 20. The outer envelope is provided with a suitable atmosphere to keep as much of the heat generated by the capsule from reaching the outer envelope as is consistent with efficient operation of the lamp. A suitable atmosphere is vacuum or inert gas. As shown the light source capsule 20 is represented as an incandescent capsule containing a halogen gas and operating on the well-known halogen cycle. Such light sources have a high light output, long life, and operate at very high temperatures. Alternatively, the light source capsule could be an arc discharge source, although in that instance a suitable ballast would necessarily be provided.

The lamp 10 has a base 25, which, in this instance, is shown as an Edison base provided with an electrically conducting shell 26 having screw threads 30, an insulating disc 35 and an electrically conducting eyelet 40. Other types of bases may, of course, be utilized. A first electrically conductive in-lead 45 is connected to the eyelet 40 and extends into the lamp 10 and through seal 50. A second electrically conductive in-lead 55 is electrically connected to the shell 26 and also extends into the lamp 10 through seal 50. The filament 60 of capsule 20 is connected to the in-leads 45 and 55 via capsule leads 45*a* and 55*a*. A fuse 65 is operatively mounted in the base in series with one of the in-leads, in this instance, in-lead 45.

A safety switch 70 is mounted in the outer envelope and tensioned theregainst whereby, in the event of breakage of the outer envelope, electrical will be made across the in-leads 45 and 55, causing a short circuit and opening fuse 65, thereby permanently removing power from the capsule 20 and achieving its extinguishments.

Figure 2:
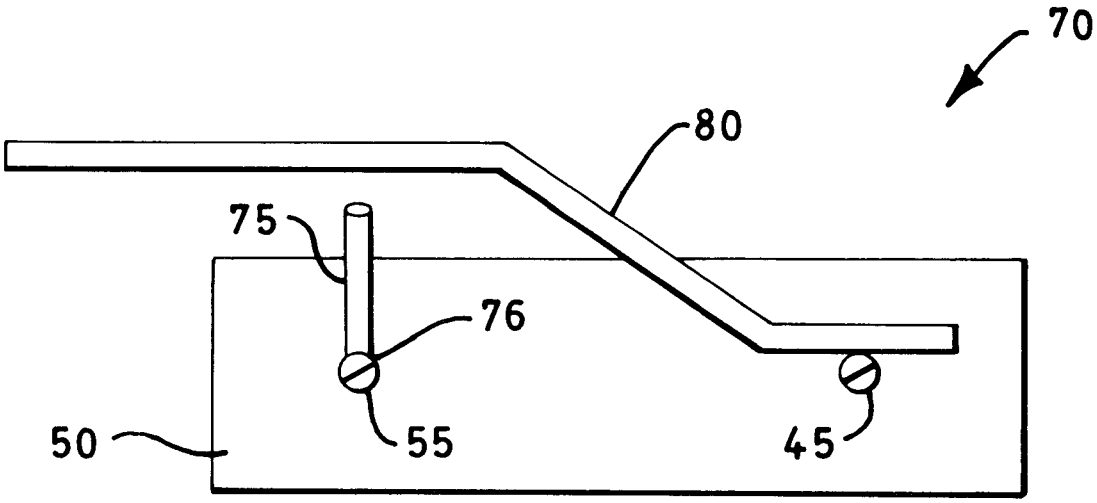
FIG. 2 is a sectional plan view along the line 2—2 of FIG. 1 illustrating the safety switch in a tensioned position.
Figure 3:
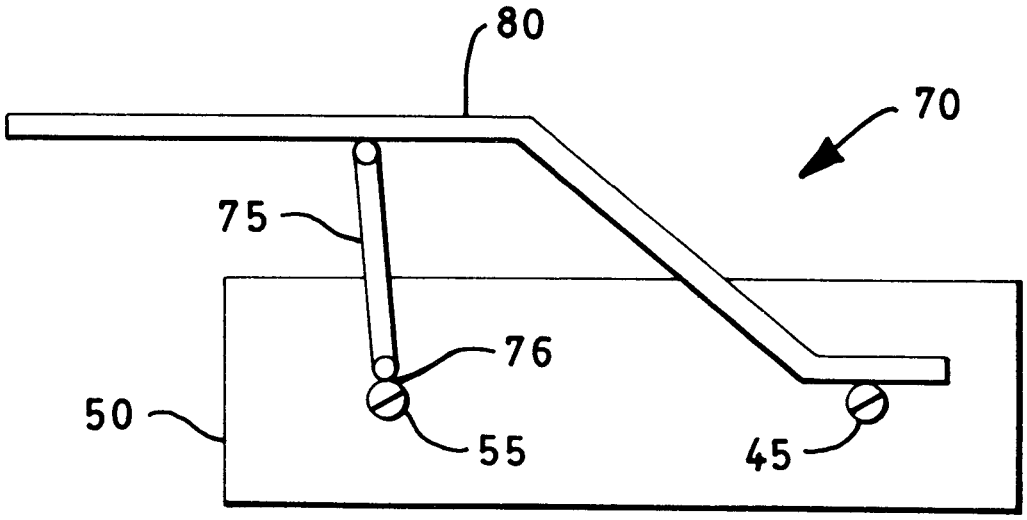
FIG. 3 is a similar view of the switch in its released position.

The safety switch 70 comprises a very fine, flexible, electrically conducting wire 75 having spring-like characteristics, attached at its proximal end 76 to one of the in-leads, in this instance in-lead 55. Its distal end 77 is in tensioned contact with the inside surface of the outer envelope 15. A suitable material for the flexible wire or ribbon is spring steel, moly or tungsten having a diameter of 0.006 to 0.016 inches inches. A shorting bar 80 is preferably attached to the other of the in-leads, in this instance 55 (see particularly FIGS. 2 and 3) and extends beyond but spaced from the other in-lead. The position of the safety switch is shown in FIG. 2 in its open position with the outer envelope 15 of the lamp 10 intact. If the outer envelope 15 is broken, the tension induced into the flexible wire 75 will cause it to straighten and contact shorting bar 80, as seen in FIG. 3, thus causing an increase in the electrical current and, in turn, causing the fuse 65 to open and extinguishing the capsule 20, thereby protecting careless persons from coming in contact with the very hot surface of the capsule 20.

This mechanical-electrical safety switch is economical to manufacture and to employ and greatly increases the safety of lamps employing high temperature light source capsules within an outer envelope.

While there have been shown and described what are at present considered the preferred embodiments of the invention, it will be apparent to those skilled in the art that various changes and modifications can be made herein without departing from the scope of the invention as defined by the appended claims.

What is claimed is:

1. In a lamp having an outer envelope, a light source capsule mounted within said outer envelope, a base, in-leads appropriately electrically connected to said base and said light source capsule whereby electrical power can be supplied to said light source, and a fuse operatively mounted with one of said in-leads in said base, the improvement comprising:

a safety switch mounted in said outer envelope and tensioned thereagainst, whereby in the event of breakage of said outer envelope, said safety switch will release and electrically contact said in-leads causing a short circuit and opening said fuse, thereby removing power from said light source capsule.

2. The lamp of claim 1 wherein said safety switch includes a thin, flexible, electrically conducting wire or ribbon.

3. The lamp of claim 2 wherein said thin, flexible electrically conducting wire or ribbon is mounted to one of said in-leads.

4. The lamp of claim 1 wherein said safety switch comprises a shorting bar mounted upon one of said in-leads and spaced from the other of said in-leads and a tensioned contact attached to said other of said in-leads at a proximal end and positioned against said outer envelope at a distal end.

* * * * *